US010421027B2

(12) United States Patent
Sufer et al.

(10) Patent No.: US 10,421,027 B2
(45) Date of Patent: Sep. 24, 2019

(54) INTERACTIVE ROBOTIC TOY

(71) Applicant: WowWee Group Ltd., TST East (HK)

(72) Inventors: Davin Sufer, Montreal (CA); Anthony Lemire, Montreal (CA); Sydney Wiseman, Montreal (CA)

(73) Assignee: WOWWEE GROUP LTD., TST East (HK)

( * ) Notice: Subject to any disclaimer, the term of this patent is extended or adjusted under 35 U.S.C. 154(b) by 0 days.

(21) Appl. No.: 15/963,181

(22) Filed: Apr. 26, 2018

(65) Prior Publication Data

US 2019/0118105 A1 Apr. 25, 2019

Related U.S. Application Data

(63) Continuation-in-part of application No. 15/802,578, filed on Nov. 3, 2017.

(60) Provisional application No. 62/649,600, filed on Mar. 29, 2018, provisional application No. 62/503,363, filed on May 9, 2017.

(51) Int. Cl.

| | |
|---|---|
| ***A63H 13/02*** | (2006.01) |
| ***A63H 13/00*** | (2006.01) |
| ***A63H 3/28*** | (2006.01) |

(52) U.S. Cl.

CPC ..... *A63H 13/005* (2013.01); *A63H 3/28* (2013.01); *A63H 13/02* (2013.01); *A63H 2200/00* (2013.01)

(58) Field of Classification Search

CPC .... A63H 3/48; A63H 13/005; A63H 2200/00; A63H 13/02

USPC ..... 446/298, 300, 301, 337, 338, 353

See application file for complete search history.

(56) References Cited

U.S. PATENT DOCUMENTS

| | | | | |
|---|---|---|---|---|
| 4,568,307 A * | 2/1986 | Gabler | A63H 7/04 446/448 |
| 5,902,169 A * | 5/1999 | Yamakawa | A63H 3/48 446/337 |
| 6,068,536 A * | 5/2000 | Madland | A63H 3/365 446/337 |
| 6,149,490 A * | 11/2000 | Hampton | A63H 3/28 446/298 |
| 6,322,420 B1 * | 11/2001 | Daniellian | A63H 3/36 446/300 |

(Continued)

FOREIGN PATENT DOCUMENTS

| | | |
|---|---|---|
| CA | 2881553 A1 | 8/2016 |
| CN | 101329558 A | 12/2008 |

(Continued)

*Primary Examiner* — Alexander R Niconovich

(74) *Attorney, Agent, or Firm* — Epstein Drangel LLP; Robert L. Epstein

(57) ABSTRACT

An interactive robotic toy including: a body section and a head section rotatably coupled with the body section. The head section includes a fixed jaw. A motor operates to rotate the head section relative to the body section. At least one touch sensor is provided for detecting touch. A processor is coupled with the motor and the touch sensor. The processor controls the motor to rotate the head section relative to the body section in response to the actuation of the touch sensor. A jaw is pivotally mounted to the head section and moveable between an open position remote from the fixed jaw and a closed position proximate the fixed jaw as the head section is rotated relative the body section by the motor.

3 Claims, 10 Drawing Sheets

(56) References Cited

U.S. PATENT DOCUMENTS

| | | | | |
|---|---|---|---|---|
| 6,371,826 | B1 * | 4/2002 | Pestonji | A63H 3/48 446/298 |
| 6,454,626 | B1 * | 9/2002 | An | A63H 3/48 446/330 |
| 6,565,407 | B1 * | 5/2003 | Woolington | A63H 3/28 446/175 |
| 6,672,934 | B2 * | 1/2004 | Hornsby | A63H 3/48 446/129 |
| 6,699,098 | B1 * | 3/2004 | Kau | A63H 5/00 446/268 |
| 7,029,361 | B2 * | 4/2006 | Seibert | A63H 3/14 446/26 |
| 7,322,874 | B2 * | 1/2008 | Ellman | A63H 3/365 446/337 |
| 7,695,341 | B1 * | 4/2010 | Maddocks | A63H 13/02 446/330 |
| 9,108,115 | B1 * | 8/2015 | Fung | A63H 3/28 |
| 2001/0029147 | A1 * | 10/2001 | Hornsby | A63H 11/20 446/356 |
| 2004/0198160 | A1 * | 10/2004 | Fong | A63H 3/20 446/330 |
| 2012/0022688 | A1 * | 1/2012 | Wong | G06N 3/008 700/253 |

FOREIGN PATENT DOCUMENTS

| | | | |
|---|---|---|---|
| CN | 101745230 | A | 6/2010 |
| CN | 101890239 | A | 11/2010 |
| CN | 204891193 | U | 12/2015 |
| CN | 105983239 | A | 10/2016 |
| CN | 207575776 | U | 7/2018 |
| JP | H0780159 | A | 3/1995 |
| JP | 2003024654 | A | 1/2003 |

* cited by examiner

INTERACTIVE ROBOTIC TOY

CROSS-REFERENCE TO RELATED APPLICATIONS

Priority is claimed on Provisional Patent Application No. 62/503,363, filed on May 9, 2017 and on Provisional Patent Application No. 62/649,600, filed Mar. 29, 2018, the entire contents of both of which are incorporated herein by reference and is a Continuation-In-Part of U.S. Utility patent application Ser. No. 15/802,578, filed Nov. 3, 2017.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to interactive robotic toys and in particular to an interactive robotic toy in the form of a creature with a head having a mouth with a moveable and jaw in which the jaw can be moved to simulate the opening and closing of the mouth in response to a particular stimulus, in conjunction with the movement of the head or separately.

2. Description of Prior Art Including Information Disclosed Under 37 CFR 1.97 and 1.98

Toys that cling to fingers and finger puppets are known in the art. Such toys provide entertainment to children and adults. U.S. Pat. No. 7,029,361 to Seibert et al, entitled "Finger puppets with sounds" directs to a toy being held on or by a finger, which includes a body having a top end and a bottom end, and means for mounting the toy on a finger coupled to the body. The toy also includes a computer chip and a speaker, within the body, for generating sound. The toy further includes a switch electrically connected to the computer chip and a finger tapper movably mounted to the bottom end of the body. When the finger tapper is depressed, the switch is actuated to cause the generation of the sound.

U.S. Utility patent application Ser. No. 15/802,578, filed Nov. 3, 2017, discloses an interactive robotic toy which can cling to a finger of a person and which exhibits a plurality of physical animations in response to user actions, such as kissing, cradling, hanging upside down, petting and the like. It further discloses an interactive robotic toy wherein the physical animation is a combination of sound and motion, including head motion, eyes blinking or sound animations (e.g., sound of laughing, sound of sneezing, sound of a kiss and the like).

However, there are no interactive robotic toys in which the jaw can move to simulate the opening and closing of the mouth to create a more realistic experience for the user. Further, there are no interactive robotic toys in which the jaw can move in conjunction with the movement of the head or separately from the movement of the head. The present invention provides that feature.

BRIEF SUMMARY OF THE INVENTION

It is therefore a prime object of the present invention to provide an interactive robotic toy wherein the toy embodies a creature with a rotatable head section including a fixed jaw and a moveable jaw.

It is another object of the present invention to provide an interactive robotic toy wherein the moveable jaw can be moved between an open position remote from the fixed jaw and a closed position proximate to the fixed jaw.

It is another object of the present invention to provide an interactive robotic toy wherein the moveable jaw is moved between its open position and its closed position as the head section is rotated.

It is another object of the present invention to provide an interactive robotic toy wherein the moveable jaw is moved between its open position and its closed position as the head section is rotated between its forward position and a position remote from its forward position.

It is another object of the present invention to provide an interactive robotic toy wherein the moveable jaw is in its closed position when the head section is in its forward position.

It is another object of the present invention to provide an interactive robotic toy wherein the moveable jaw is in its open position when the head section is rotated away from its forward position.

The above objects are achieved by the present invention which is directed to an interactive robotic toy including: a body section; a head section rotatably coupled with the body section. The head section includes a fixed jaw. The toy further includes a motor operative to rotate the head section relative to the body section. At least one touch sensor is provided for detecting touch. A processor is coupled to the motor and the touch sensor. The processor controls the motor to rotate the head section relative to the body section in response to the actuation of the touch sensor. The toy also has a jaw pivotally mounted to the head section and moveable between an open position remoted from the fixed jaw and a closed position proximate the fixed jaw as the head section is rotated relative the body section by the motor.

The toy further includes a cam connected to the body section. A protrusion extends from the cam. A lever is coupled to the moveable jaw such that the protrusion causes the lever to move the moveable jaw from its open position toward its closed position as the head section is rotated by the motor.

The lever includes a downwardly extending part. The protrusion is situated under the lever such that the lever moves the moveable jaw toward its closed position as the lever part is engaged by the protrusion.

The lever has a middle section. The lever part is situated proximate the middle section of the lever. The lever part is engaged by the cam protrusion when the head section is in its forward position relative to the body section.

The motor can move the head section relative to the body section between a forward position and first and second positions remote from and on opposite sides of the forward position. The lever part is remote from the protrusion when the head section is in either of its positions remote from its forward position. Gravity moves the moveable jaw towards its open position when the lever part is remote from the protrusion.

The lever has a generally "U" shape. The lever has first and second end. Each of the lever ends are connected to the moveable jaw.

The moveable jaw has a generally "U" shape. The moveable jaw is attached to the head section by a hinge.

The cam includes a second protrusion extending from the cam spaced from the first protrusion and situated over the lever. The second protrusion acts as a stop limiting the upward movement of the lever.

BRIEF DESCRIPTION OF THE SEVERAL VIEWS OF DRAWINGS

To these and to such other objects that may hereinafter appear, the present invention relates to an interactive robotic toy as described in detail in the following specification and recited in the annexed claims, taken together with the accompanying drawings, in which like numerals refer to like parts and in which:

DETAILED DESCRIPTION OF THE INVENTION

The present invention overcomes the disadvantages of the prior art by providing an interactive robotic toy which can cling to a finger of a person. The robotic toy exhibits a plurality of physical animations in response to user actions. Such actions may include kissing, cradling, hanging upside down, petting and the like. The physical animation is a combination of sound and motion and may include head motion, eyes blinking or sound animations (e.g., sound of laughing, sound of sneezing, sound of a kiss and the like).

Figures 1A, 1B:
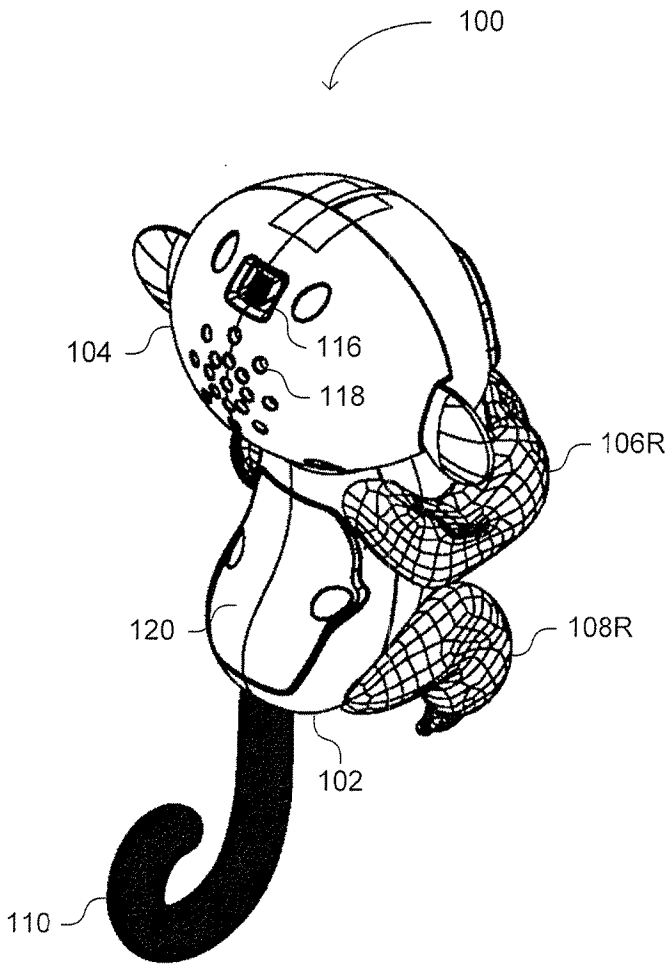
FIGS. 1A-1G are schematic illustrations of interactive robotic toy, constructed and operative in accordance with an embodiment of the disclosed technique.
Figure 1C:
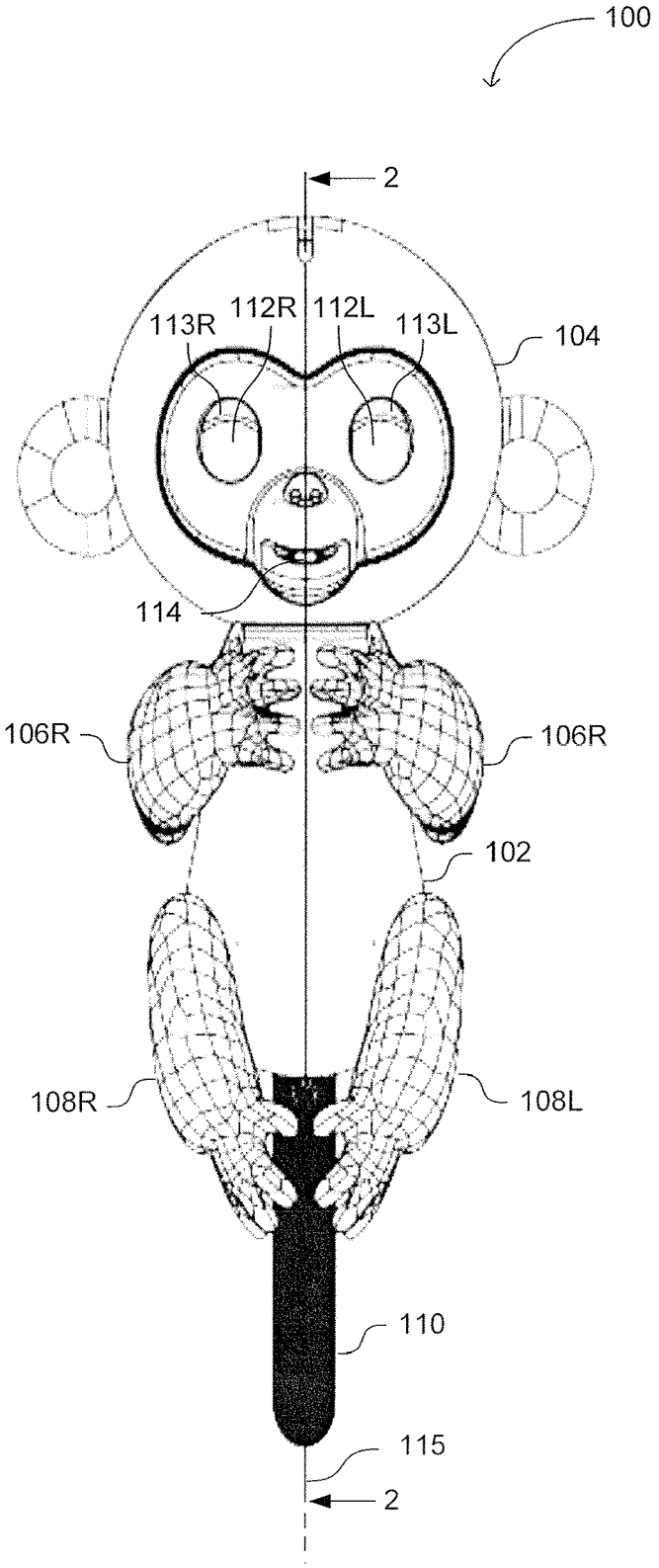
Figure 1D:
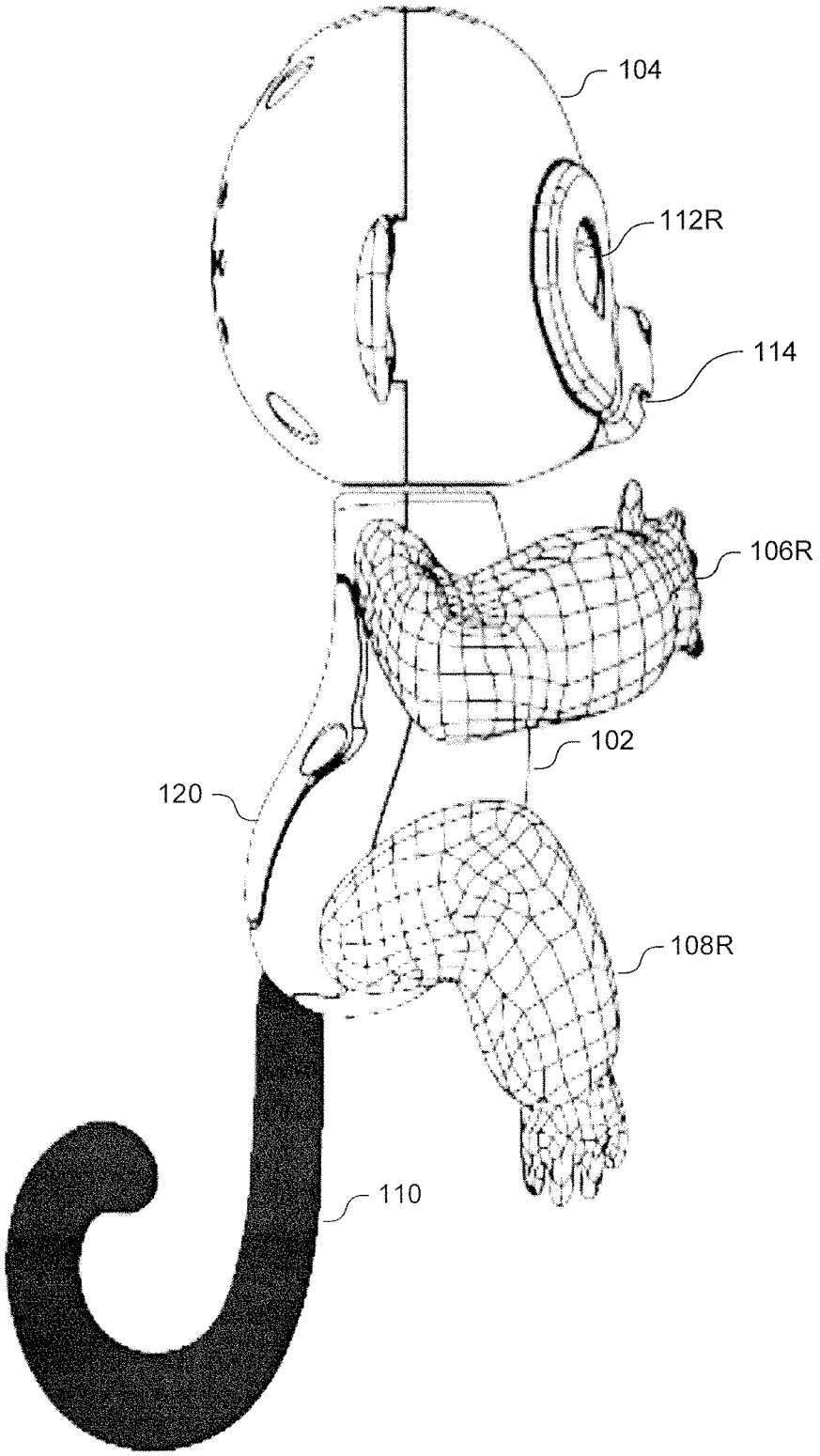
Figure 1E:
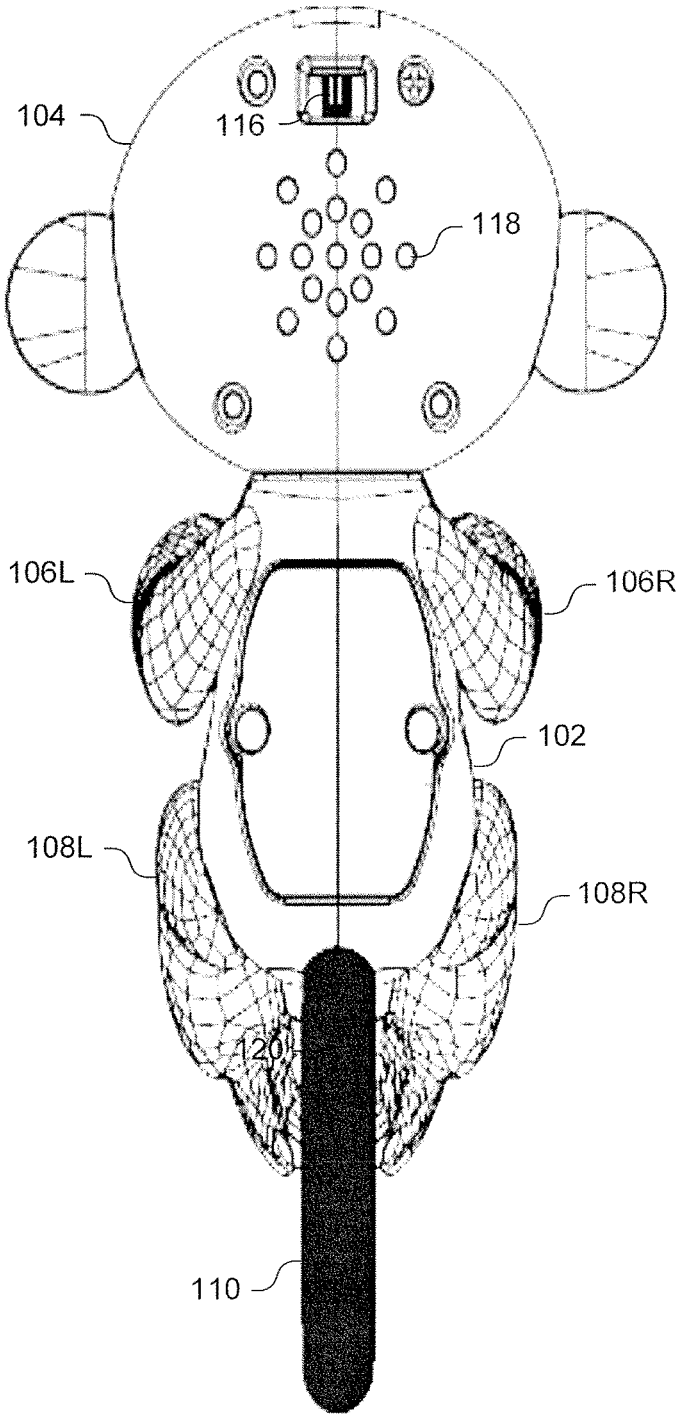

Reference is now made to FIGS. 1A-1G, which is a schematic illustration of an interactive robotic toy, generally referenced 100, constructed and operative in accordance with an embodiment of the disclosed technique. FIG. 1A is an isometric front view of Interactive robotic toy 100. FIG. 1B is an isometric front back of Interactive robotic toy 100. FIG. 1C is a front view of Interactive robotic toy 100. FIG. 1D is a side view of Interactive robotic toy 100 and FIG. 1E is a back view of Interactive robotic toy 100. Interactive robotic toy 100 includes a body section 102 and a head section 104 rotatably coupled with body section 102. Interactive robotic toy 100 further includes flexible left and right arms 106L and 106R respectively, flexible left and right legs 108L and 108R respectively and a flexible tail 110. Flexible left and right arms 106L and 106R, flexible left and right legs 108L and 108R and flexible tail 110 are all coupled with body section 102. Body section 102 further includes a batteries cavity in which batteries are located, covered by battery cover 120. Head section 104 includes left and right eyes 112L and 112R, a mouth opening 114, an on-off switch 116 and loudspeaker holes such as hole 118. Left and right eyes 112L and 112R may be embodied as spheres rotating about an axis perpendicular to axis 115. Half of the spheres are of a color similar to the body color of interactive robotic toy 100 (i.e., emulating eye lids). This half is referred to herein as the "lids side". The other half of the sphere are of a dark color (e.g., black) thus emulating the eyes, referred to as the "eyes side". When Left and right eyes 112L and 112R are rotated such that the eyes side thereof are facing the user, Left and right eyes 112L and 112R appear to be open. When Left and right eyes 112L and 112R are rotated such that the lids side thereof are facing the user, left and right eyes 112L and 112R appear to be closed. Alternatively, left and right eyes 112L and 112R include respective left and right eye lids 113L and 113R operable to cover or uncover the respective left and right eyes 112L and 112R (i.e., close or open left and right eyes 112L and 112R). Interactive robotic toy 100 may cling to a finger of a user via the flexible limbs thereof (i.e., left and right arms 106L and 106 R, left and right legs 108L and 106 R or tail 110). A cross sectional view of interactive robotic toy 100 is depicted in FIG. 1E.

As mentioned above, interactive robotic toy 100 includes a plurality of physical animations in response to various actions by the user. For example, when interactive toy 100 is turned on, interactive robotic toy 100 may sound a laugh, and blink. When hanged upside down via tail, interactive robotic toy 100 may produce sounds associated with excitement. When cradled, interactive robotic toy 100 may produce sounds associated with content and close eyes 112L and 112R.

Figure 1F:
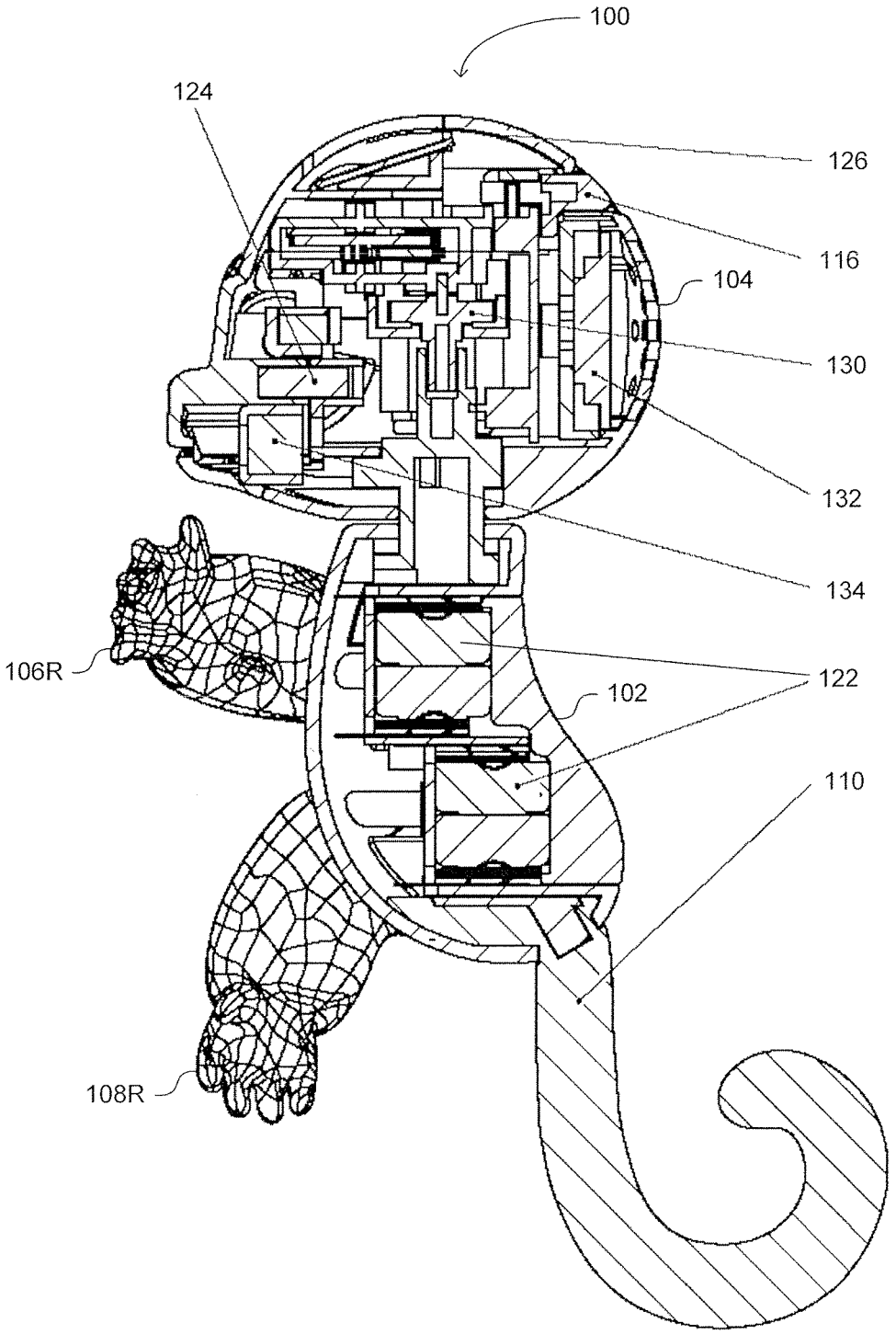
Figure 1G:
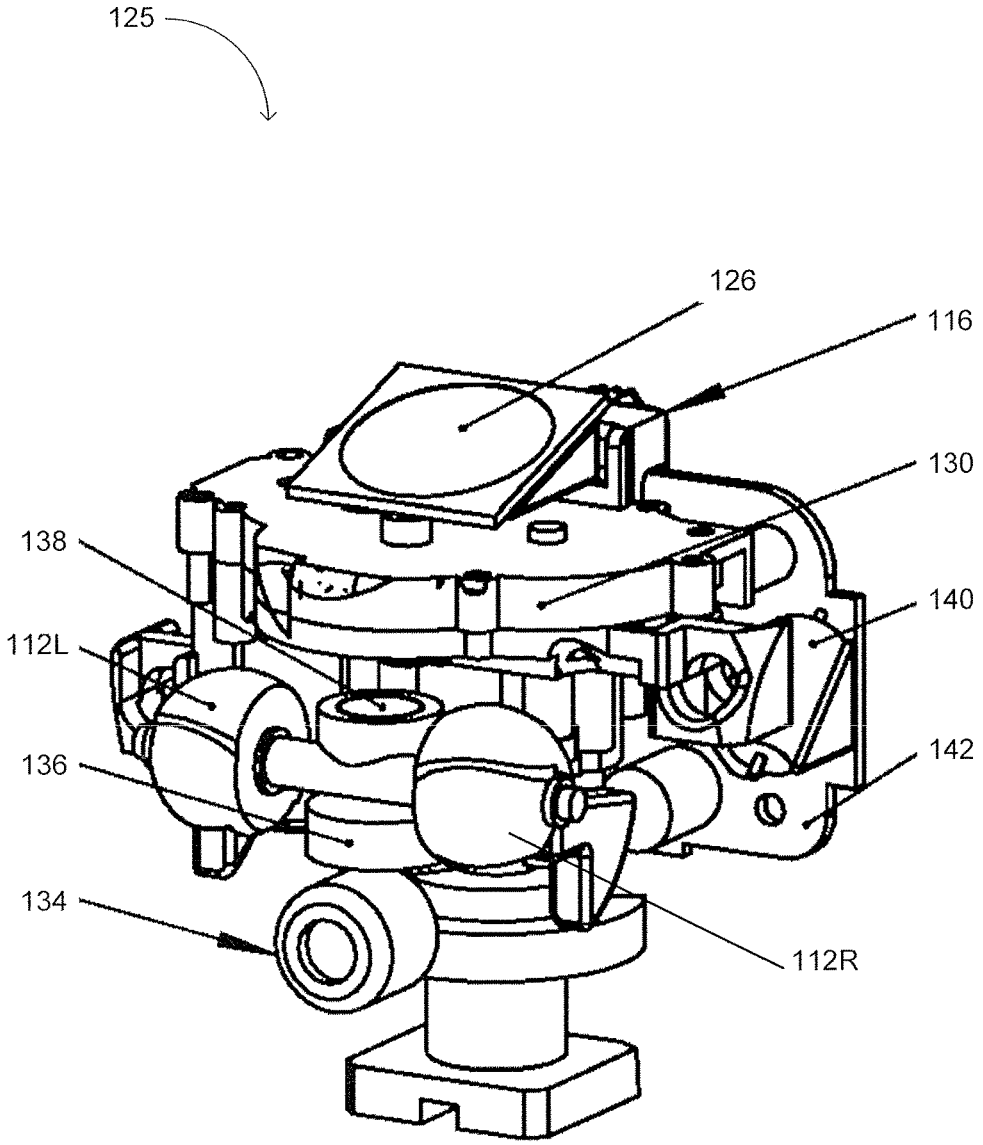

With reference to FIGS. 1F and 1G, a system 125 operating interactive robot toy 100 is located within head section 104. The power supply (e.g., batteries) operating the system are located within body section 102. The system operating interactive robotic toy 100 includes an eyes blink actuator 124, at least one touch sensor 126, a motor and gears 130, a speaker 132 attached to a PCB 142 and at least one sound sensor 134 (e.g., microphone) and at least one orientation sensor 140 (e.g., ball switch, gyroscope, Accelerometer). Eyes blink actuator 124 includes a solenoid 136 and a magnet 138. The operation of the system operating an interactive robotic toy such as interactive robotic toy 100 is further explained in conjunction with FIG. 2.

Figure 2:
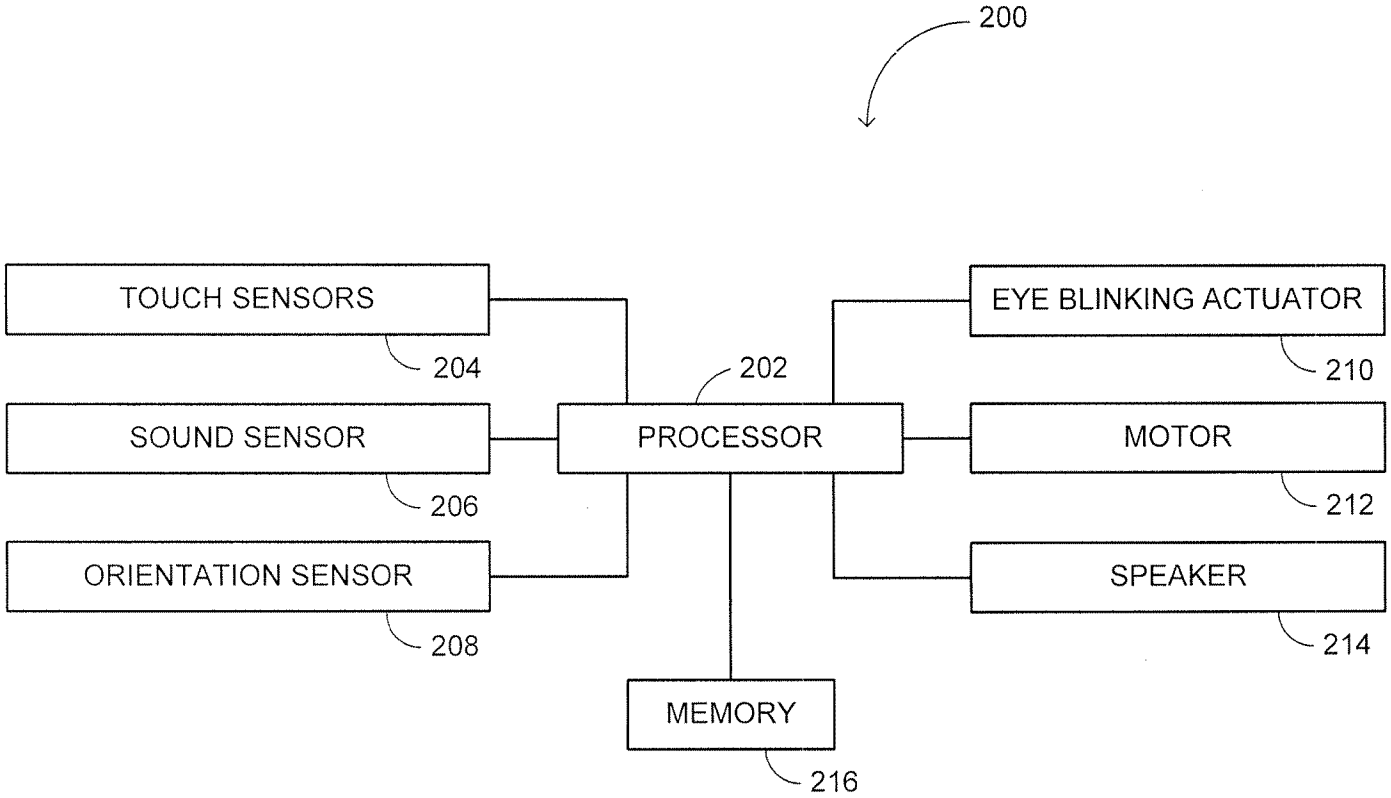
FIG. 2 is a schematic illustration of a system for operation an interactive robotic toy, in accordance with another embodiment of the disclosed technique.

Reference is now made to FIG. 2, which is a schematic illustration of a system, generally referenced 200, for operation an interactive robotic toy, in accordance with another embodiment of the disclosed technique. System 200 includes a processor 202. System 200 further includes at least one touch sensor 204, at least one sound sensor 206, an orientation sensor 208, an eyes blink actuator 210, a motor 212, a speaker 214 and a memory 216 all coupled with processor 202. Eyes blink actuator 210 may be embodied as a solenoid and a magnet or as a motor and gears. Touch sensor 204 is, for example, a capacitive touch sensor. Sound sensor 206 may be embodied as a microphone. Orientation sensor 208 is, for example, at least one ball switch, a gyroscope or an accelerometer, detecting information relating to the orientation of interactive robotic toy 200 about selected axes. Memory 216 stores a plurality of physical animations for interactive robotic toy. A physical animation is defined as a combination of sound animation and motion animation. A motion animation is, for example, the motion of the head and the blinking of the eyes of the interactive robotic toy.

Touch sensor 204 detects touch, for example, on the head section of the interactive robotic toy, produces a signal indicative that the head section was touched and provides that signal to processor 202. Orientation sensor 208 detects information relating to the orientation of interactive robotic toy 200, produces a signal or signals respective of this information. Sound sensor 208 detects sound in the vicinity of the interactive toy, produces a signal indicative to that sound and provides this signal to processor 202. As mentioned above, interactive robotic toy may include two or more sound sensors, which define an array of microphones.

Processor 202 receives the signals produced by touch sensor 204, sound sensor 206 and orientation sensor 208. Processor 202 determines when interactive robotic toy 200 was touched according to the signal received from touch sensor 204. Processor 202 determines when a sound was made in the vicinity of interactive robotic toy 200 and the nature of this sound (e.g., the detected sound is a sound of a kiss). For example, processor 202 compares the time signature or the frequency signature (e.g., a Fourier Transform of the time signal) or both to stored signatures. When an array of microphones is employed processor 202 may further determine the direction from which the sound arrived at interactive robotic toy 200, for example, by employing interferometry techniques or correlation based techniques (e.g., Multiple Signal Classification—MUSIC).

Processor 202 selects a physical animation or animations associated with the received signals and the information (e.g., nature of the received sound received, direction or arrival of the received sound or the orientation of interactive robotic toy 200) derived therefrom. Once processor 202 selects the physical animation or animations, processor 202 produces corresponding signal to eyes blink actuator 210, motor 212 and speaker 214 to produce the selected animation.

For example, when the interactive robotic toy is held upright and touched on the head, motor 212 moves the head from side to side and speaker 214 produces a laughing sound. As a further example, when the interactive robotic toy is held horizontally (e.g., cradled) eyes blink actuator 210 rotates the eyes or the eye lids such that the eyes of the interactive robotic toy appear closed and speaker 214 produces a snoring sound.

As another example, when the interactive toy is held upside down, orientation sensor 208 detects the orientation of interactive toy 200 and provides processor 202 with information relating thereto. Consequently processor 202 instructs eyes blink actuator 210 to rotate the eyes or the eye lids such that the eyes of the interactive robotic toy appear, and speaker 214 produce a sound associated with excitement (e.g., a "Yehh" cry).

As yet another example, when a user kisses the interactive robotic toy (i.e., sound sensor 206 detects the sound of a kiss), the speaker 214 produces the sound of a kiss. Furthermore, when an array of microphones is employed and the direction of arrival of the sound is determined, motor 212 rotates the head of the interactive robotic toy to turn toward the direction from which the sound arrived.

The interactive toy according to the disclosed technique may be in the form of different animals and creatures. For example, interactive toy 100 (FIGS. 1A-1G) exhibits the form of a monkey. However, the interactive toy according to the disclosed technique may exhibits forms of other animals and creatures. The physical animation or animations which the interactive toy produces correspond to the animal or creature. For example, a monkey shall produce sound corresponding to a monkey. A dinosaur or a lion shall produce corresponding roars animating anger, or purrs animating pleasure or content (e.g. when the head of the interactive toy is stroked).

With reference to FIGS. 1G and 2, the interactive toy system (e.g., interactive toy system 125—FIG. 1G or interactive toy system 200—FIG. 2) may include at least two touch sensors located on the head. When a user strokes the head of the interactive toy, touching the two touch sensors in sequence (e.g., petting the interactive toy), these touch sensors shall produce a signal in sequence. The processor (e.g., processor 202) detects this sequential touching of the two touch sensors and interprets this as action of stroking. Thereafter, processor 202 may select a pacified or content animation. For example, the user may stroke the dinosaur and the processor shall select a purr sound. According to another example, when the user shakes the dinosaur, the dinosaur roars. Shaking is detected, for example, according to the derivative of the orientation of interactive toy 200.

The interactive toy according to the present invention may further interact with the user by opening and closing the mouth thereof. Reference is now made to FIGS. 3A-3F which are schematic illustrations of an interactive toy, generally referenced 300, constructed and operative in accordance with a further embodiment of the disclosed technique. Interactive toy 300 is similar to interactive toy 100. However, interactive toy 300 exhibits the form of a dinosaur. Interactive toy 300 interacts with the user as described above in conjunction with FIGS. 1A-1G and 2 and further interacts with the user by opening and closing the mouth thereof. For example, as the head of interactive toy 300 rotates, the mouth of interactive toy 300 opens as further explained herein below.

Figure 3B:
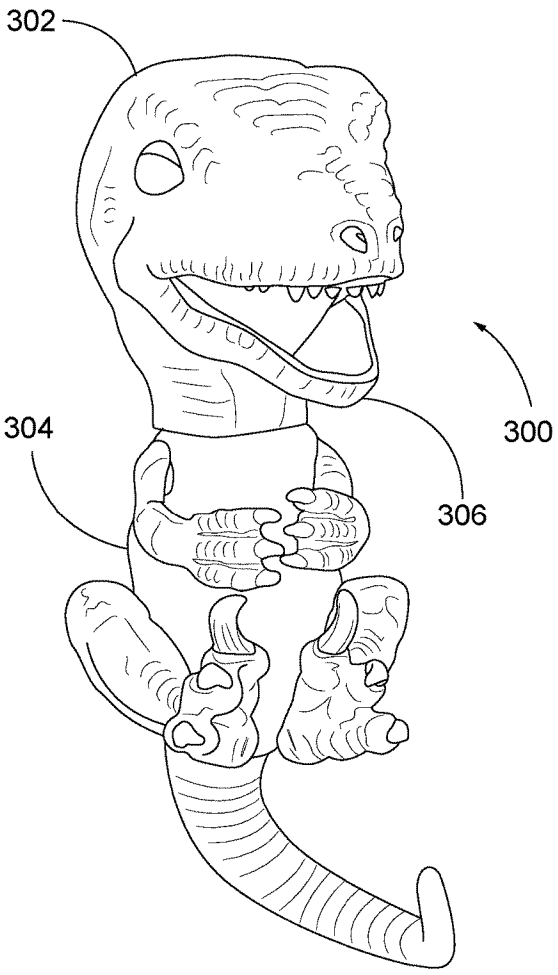
FIGS. 3A-3F are schematic illustrations of an interactive toy, constructed and operative in accordance with a further embodiment of the disclosed technique.
Figure 3A:
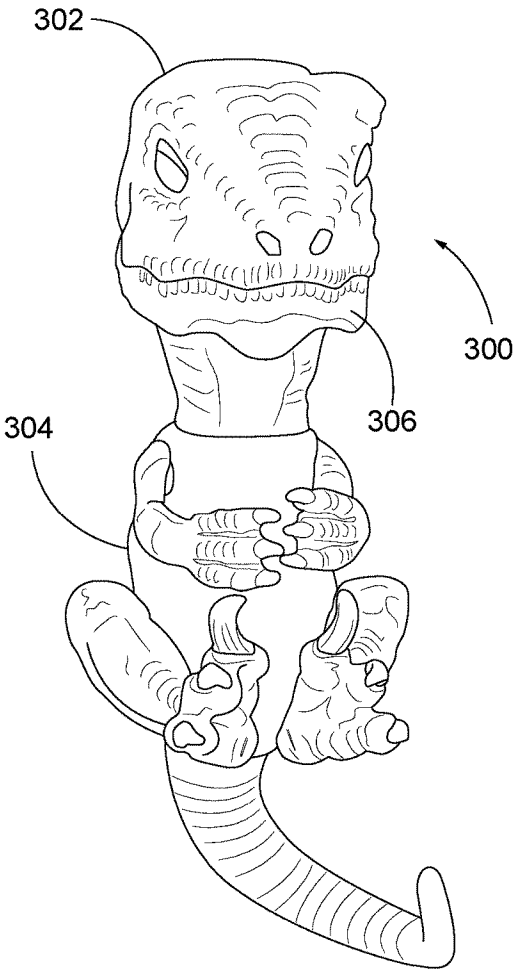

With reference to FIG. 3A, head 302 of interactive toy 300 is in a forward position relative to body 304. With reference to FIG. 3B, head 302 is rotated to the left from the forward position thereof. As head 302 rotated from its forward position, jaw 306 of the mouth of interactive toy 300 opens. Jaw 306 is coupled with head 302 via hinges such that jaw 306 can open and close.

Figure 3D:
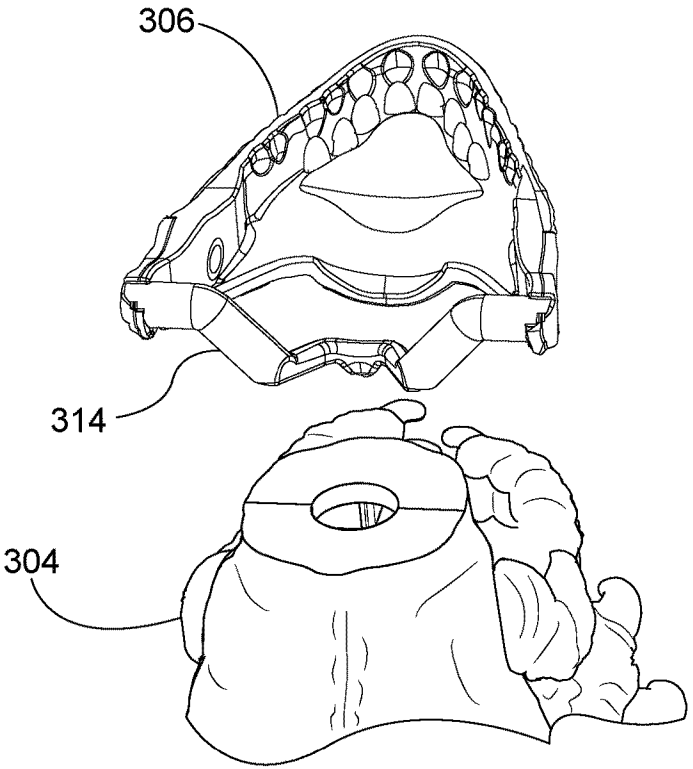
Figure 3C:
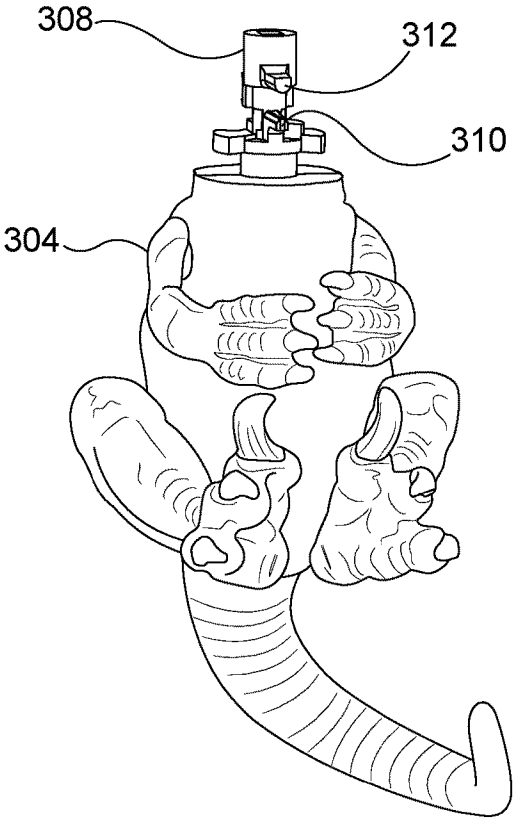

With reference to FIG. 3C, a cam 308 is rigidly coupled with body 304 (i.e., cam 308 and body 304 do not move one with respect to the other). Cam 308 includes two protrusions, a first protrusion 310 and second protrusion 312. With reference to FIG. 3D, jaw 306 exhibits a general shape of the letter 'U'. A lever 314 is coupled with jaw 306 such that when lever 314 rises, jaw 306 also rises. Lever 314 also exhibits the general shape of the letter 'U'. Each end of lever 314 is coupled with a respective end of jaw 306.

Figure 3F:
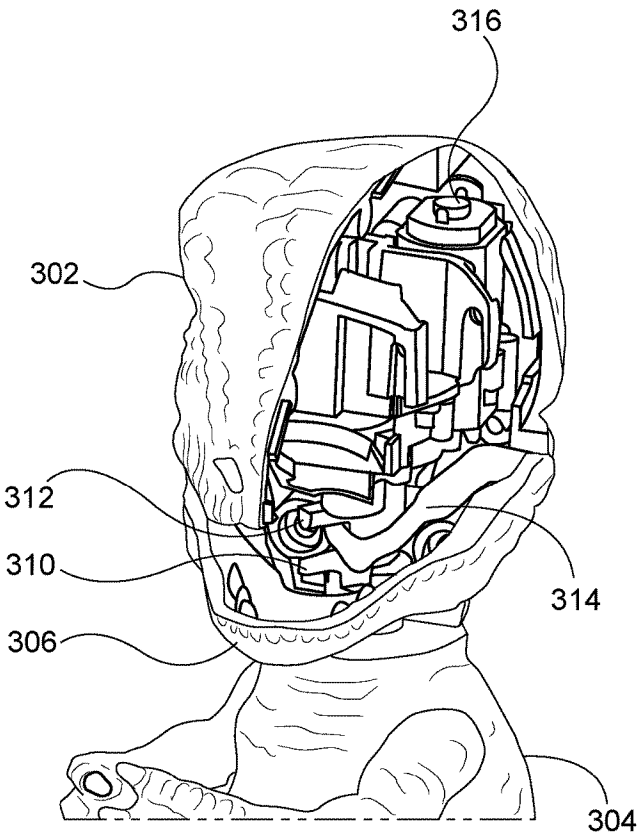
Figure 3E:
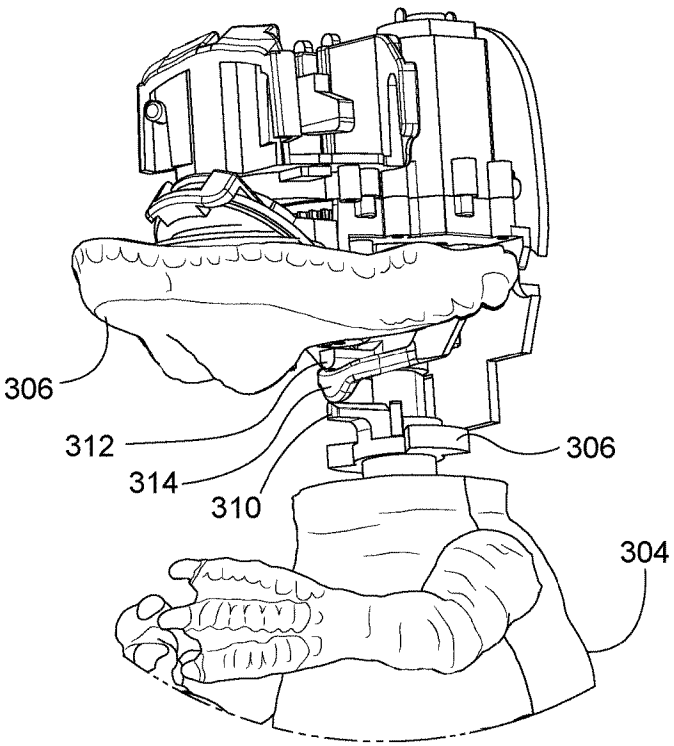

With reference to FIG. 3D, interactive toy 300 is depicted with head 302 in the forward position. In this position, protrusion 310 pushes on lever 314 upward and lever 314 closes jaw 306. With reference to FIG. 3F, the body of a motor 316 coupled with head 302 at the inner side thereof. The rotating shaft of motor 316 is coupled with cam 308. As the rotating shaft of motor 316 rotates, head 302 also rotates relative body 304 and protrusion 310 moves relative to U shaped lever 314 toward of the ends of U shaped lever 314. Consequently jaw 306 is lowered by the force of gravity and the mouth of interactive toy 300 opens.

According to another embodiment of the present invention, jaw 306 may be coupled directly or via lever 314 to a solenoid or a motor which actively lowers and raises jaw 306.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

We claim:

1. An interactive robotic toy comprising:

a body section;

a substantially cylindrical cam having a central axis, said cam being rigidly coupled to said body section;

a protrusion extending from said cam in a direction substantially orthogonal to said central axis of said cam;

a head section surrounding said cam, rotatably coupled with said body section and comprising a fixed jaw;

a motor, operative to rotate said head section around said cam relative to said body section between first and second positions;

at least one touch sensor for detecting touch;

a processor coupled with said motor and said touch sensor, said processor controlling said motor to rotate said head section around said cam relative to said body section in response to the actuation of said touch sensor;

a jaw pivotally mounted to said head section and moveable between an open position remoted from said fixed jaw and a closed position proximate said fixed jaw, and a member having a "U" shaped portion fixed to said pivotally mounted jaw and in contact with said cam protrusion such that said pivotally mounted jaw moves relative to said fixed jaw as said motor moves said head section.

2. The toy of claim 1 wherein said cam comprises a second protrusion, spaced from said cam protrusion and wherein said member is situated between said cam protrusion and said second protrusion.

3. The toy of claim 2 wherein said second protrusion extends from said cam in a direction substantially orthogonal to said central axis of said cam.

* * * * *